US007491044B2

(12) United States Patent
Fujioka

(10) Patent No.: US 7,491,044 B2
(45) Date of Patent: Feb. 17, 2009

(54) SEALING DEVICE OF FLUID MACHINERY

(75) Inventor: Tamotsu Fujioka, Yokohama (JP)

(73) Assignee: Anest Iwata Corporation (JP)

( * ) Notice: Subject to any disclaimer, the term of this patent is extended or adjusted under 35 U.S.C. 154(b) by 0 days.

(21) Appl. No.: 11/861,743

(22) Filed: Sep. 26, 2007

(65) Prior Publication Data

US 2008/0075614 A1 Mar. 27, 2008

(30) Foreign Application Priority Data

Sep. 27, 2006 (JP) ..... 2006-261638

(51) Int. Cl.
*F03C 2/00* (2006.01)
*F03C 4/00* (2006.01)

(52) U.S. Cl. ..... 418/55.2; 418/55.4; 418/149; 277/589; 277/584

(58) Field of Classification Search ..... 418/55.1–55.6, 418/57, 142; 277/589, 581, 545, 385
See application file for complete search history.

(56) References Cited

U.S. PATENT DOCUMENTS 2,456,356 A * 12/1948 Aber ..... 277/584
4,087,099 A * 5/1978 Kurio ..... 418/142
4,244,588 A * 1/1981 Langewisch ..... 277/589
5,037,281 A 8/1991 Lane et al.
5,632,612 A * 5/1997 Shaffer ..... 418/142
2001/0038800 A1 11/2001 Kimura et al.

FOREIGN PATENT DOCUMENTS

JP 4-214977 A 8/1992
JP 2001-248576 A 9/2001

* cited by examiner

*Primary Examiner*—Theresa Trieu
(74) *Attorney, Agent, or Firm*—Rossi, Kimms & McDowell LLP

(57) ABSTRACT

A sealing device includes a stationary member, an orbiting member, a tip end surface of which slides on an inner face of the stationary member, and a sealing member to be fitted into a sealing groove engraved on the tip end surface. A sliding contact surface of the sealing member is pressed onto an inner surface of the stationary member with a predetermined force to slide on the inner surface in order that fluid sealing is secured between the sliding contact surface of the sealing member and the inner surface of the stationary member. The sealing member is divided into two parts of an upper ring and a lower ring, with the upper ring contacting the sliding contact surface and the lower ring facing a bottom surface of the sealing groove.

4 Claims, 2 Drawing Sheets

SEALING DEVICE OF FLUID MACHINERY

BACKGROUND OF THE INVENTION

1. Field of the Invention

The present invention relates to a sealing device of fluid machinery having a stationary member, an orbiting member, an end surface of which slides on an inner face of the stationary member, and a sealing member to be fitted into a sealing groove engraved on the end surface along the ridge line of the end surface, a sliding contact surface of the sealing member being pressed onto an inner surface of the stationary member with a predetermined force to slide on the inner surface in order that fluid sealing is secured between the sliding contact surface of the sealing member and the inner surface of the stationary member.

2. Description of the Related Art

In the fluid machinery such as scroll type compressors, scroll type vacuum pumps and the like, volumetric efficiencies thereof vary greatly depending on a sealing function of a working fluid between an end plate of the stationary scroll and an end surface of an orbiting scroll provided so as to revolve against the stationary scroll. Consequently, many technologies have been proposed regarding a tip seal construction between the end plate of the stationary scroll and the end surface of the orbiting scroll.

Generally, in the tip seal construction of the scroll type fluid machinery, a fluid seal between the end plate of the stationary scroll and the end surface of the orbiting scroll is secured by a construction that a sealing groove is engraved on the end surface along the ridge line of the end surface, for receiving a tip seal member fitted into the sealing groove, a sliding contact surface of the tip seal member is pressed onto an inner surface of the end plate of the stationary scroll with a predetermined force to slide on the inner surface of the end plate of the stationary scroll at the sliding contact surface.

FIG. 4 is a perspective view of an orbiting scroll of the scroll type fluid machine. In FIG. 4, the reference numeral 1 shows an orbiting scroll which moves on an inner surface of an end plate 7 (See FIG. 5) of a stationary scroll (not shown). Here, a lap 6 of a spiral wall shape is set-up on a base plate 6*a* of the orbiting scroll 1. Further, a sealing groove 10 is engraved on the wall end surface, namely, an end surface of the lap 6 along the ridge line of the end surface of the orbiting scroll 1, and a tip seal member 2 is fitted into the sealing groove 10.

FIG. 5 shows an example of conventional tip seal construction of the above described orbiting scroll 1. In the figure, reference numeral 6 shows a lap of the orbiting scroll 1, 7 is an end plate composing the stationary member, and 10 a sealing groove engraved on the end surface of the lap 6 along the ridge line of the tip end surface of the orbiting scroll 1. The numeral 02*s* shows a tip seal assembly to be fitted into the sealing groove 10, and the assembly is composed of a tip seal member 02 and a back-up ring 05. A sliding contact surface 08 of an end surface of the tip seal member 02 slides on the end plate 7, and the back-up ring 05 is made of spring materials and placed inside the tip seal member 02.

While the tip seal member 02 contacts an outer surface 05*a* of the back-up ring 05, the sliding contact surface 08 is pressed onto the inner surface of the end plate 7 by a spring force of the back-up ring 05 and a pressure force of fluid introduced into a clearance 9 inside the back-up ring 05. Thus, fluid sealing is secured between the sliding contact surface 08 of the tip seal 02 and the inner surface of the end plate 7.

Moreover, patent literature 1 (JP: 1998-214977,A) discloses a tip sealing construction having a stationary scroll, an orbiting scroll moving along the inner surface of an end plate of the stationary scroll, and a sealing member to be fitted into a sealing groove engraved on the end surface along the ridge line of the end surface, a sliding contact surface of the sealing member being pressed onto an inner surface of the end plate with a predetermined force to slide on the inner surface in order that fluid sealing is secured between the sliding contact surface of the tip sealing member and the inner surface of the end plate.

Further, in this disclosure, the tip seal member is formed by fitting a back-up member, which is a spring member having a C-shaped cross section, into an outer seal of C-shape cross section which contacts to slide on the inner surface of an end plate, and further fitting an O-ring inside the back-up member, thereby the elasticity of the O-ring and the back-up member of C-shape cross section presses the outer seal onto the inner surface of the end plate with a predetermined force, while the contact surfaces slide each other.

On the other hand, patent literature 2 (JP: 2001-248576,A) discloses a tip sealing construction of the scroll type fluid machinery, which is structured such that a seal member is fitted into a sealing groove provided to a lap so as to contact and slide on the inner surface of the end plate, and a rubber back-up ring of hollow circular cross section is placed between the tip seal member and a bottom face of the sealing groove, thereby the elasticity of the back-up ring presses the tip seal member onto the inner surface of the end plate.

In scroll type machinery, lap of the orbiting scroll is heated up during operation. On the other hand, in the conventional art of FIG. 5, the back-up ring 05 contacting the inner surface of the tip seal member via an outer surface 05*a* directly touches the lap 6 of high temperature during operation. Thus, the back-up ring 05 is heated up and deteriorated due to thermal degradation. As a result, the durability of the back-up ring 05 is lessened.

The back-up function of securing fluid sealing the sliding contact surface 08 of the tip seal member 02 and the inner surface of the end plate 7 by pressing the tip seal member 02 onto the inner surface of the end plate 7 is lowered, resulting in a lowered sealing function of working fluid as well as lowered volumetric efficiencies of fluid machinery.

In addition, in the seal construction of patent literature 1 (JP: 1998-214977,A), the tip seal member is formed by fitting a back-up member, which is a spring member having a C-shaped cross section, into an outer seal of C-shape cross section which contacts to slide on the inner surface of an end plate, and further fitting an O-ring inside the back-up member, thereby the elasticity of the O-ring and the back-up member of C-shape cross section presses the outer seal onto the inner surface of the end plate with a predetermined force, to slide on the contact surface. Therefore, the outer peripheral surface of the outer seal of C-shape cross section is pressed onto the inner surface of the end plate, substantially under a condition of line contact, so that the contact pressure in the contact part becomes high and deteriorates the durability of the outer seal and the contact surface of the outer seal is worn out. Thus the seal function between the outer seal and the inner surface of the end plate is lowered, and the volumetric efficiency of the fluid machine is decreased.

Further, because the tip seal member is structured such that a back-up member, which is a spring member having a C-shaped cross section, is fitted inside of an outer seal of C-shape cross section which and an O-ring is fitted inside the back-up member, thereby the elasticity of the O-ring and the back-up member of C-shape cross section presses the outer seal onto the inner surface of the end plate with a predetermined force, to slide on the contact surface, the seal construction is complicated, bringing difficulties such as increased man-hours as to assembling/disassembling the tip seal member.

In the construction of patent literature 2 (JP: 2001-248576, A), it is true that the tip seal member is pressed onto and slides on the inner surface of the end plate with a stable thrust force due to the elasticity of the back-up ring of hollow circular cross section, but the problem of overheating of the back-up ring remains as in the case of the above-mentioned patent literature 1 because the back-up ring made from rubber directly contacts the sealing groove of the lap.

SUMMARY OF THE INVENTION

In view of the above-stated prior art, a purpose of the present invention is to realize an extremely simple seal construction of easy assembling/disassembling, which can prevent the back-up ring from contacting the sealing groove of an orbiting member, thereby the thermal degradation of the back-up ring due to the contact, the lowered seal function of the working fluid, and the decreased volumetric efficiency can be evaded.

The present invention proposes, for achieving the above-stated purpose, a sealing construction of fluid machinery, including a stationary member, a orbiting member, an end surface of which slides on an inner face of the stationary member, and a sealing member to be fitted into a sealing groove engraved on the end surface along the ridge line of the end surface, a sliding contact surface of the sealing member being pressed onto an inner surface of the stationary member with a predetermined force to slide on the inner surface in order that fluid sealing is secured between the sliding contact surface of the sealing member and the inner surface of the stationary member, in which the sealing member is divided in a plane parallel to the sliding contact surface into two parts of an upper ring and a lower ring, the upper ring contacting the sliding contact surface and the lower ring facing a bottom surface of the sealing groove, and a back-up ring made from elastic material is provided to be fitted into grooves for the back-up ring, which are engraved on the divided surfaces of the upper ring and the lower ring, in a place not facing the sealing grooves, along the longitudinal direction of the sliding contact surface.

Another aspect of the present invention is directed to a seal construction of a scroll compressor or a scroll vacuum pump. Namely, here disclosed is a sealing device of fluid machinery including a scroll compressor or a scroll vacuum pump, having a stationary scroll, an orbiting scroll, an end surface of which slides on an inner face of the stationary scroll, and a tip seal member to be fitted into a sealing groove engraved on the end surface along the ridge line of the end surface, a sliding contact surface of the tip seal member is pressed onto the inner surface of an end plate of the stationary scroll with a predetermined force to slide on the inner surface in order that fluid sealing is secured between the sliding contact surface of the tip seal member and the inner surface of the end plate of the stationary scroll, in which the tip seal member is divided in a plane parallel to the sliding contact surface into two parts of an upper ring and a lower ring, the upper ring contacting the sliding contact surface and the lower ring facing a bottom surface of the sealing groove, and a back-up ring made from elastic material is provided to be fitted into grooves for the back-up ring, which are engraved on the divided surfaces of the upper ring and the lower ring, in a place not facing the sealing grooves, along the longitudinal direction of the sliding contact surface.

According to another aspect of the present invention, the cross section of the back-up ring is preferably a circular section, a polygon section, or a cross-shaped section.

In a sealing device of the present invention, the tip seal member to be fitted into a sealing groove engraved, on the end surface of the orbiting member, along the ridge line of the tip end surface is divided in a plane parallel to the sliding contact surface into two parts of an upper ring contacting the sliding contact surface and a lower ring facing a bottom surface of the sealing groove.

Further, in a sealing device of fluid machinery including a scroll compressor or a scroll vacuum pump of another application of the present invention, the tip seal member is fitted into a sealing groove engraved, on the end surface of the orbiting scroll sliding on an inner face of the stationary scroll, along the ridge line of the end surface is divided in a plane parallel to the sliding contact surface into two parts of an upper ring and a lower ring, the upper ring contacting the sliding contact surface and the lower ring facing a bottom surface of the sealing groove.

In the above-mentioned construction, a back-up ring made from elastic material is provided to be fitted into grooves for the back-up ring, which are engraved on the divided surfaces of the upper ring and the lower ring, in a place not facing the sealing grooves, along the longitudinal direction of the sliding contact surface. Thus, the present invention makes it possible to secure a fluid seal between the sliding contact surface and the inner face of the end plate by pressing the sliding contact surface of the upper ring 3 onto the inner face of the stationary member (the end plate) by means of a pressure of a working fluid which flows into a clearance between the sealing groove and the tip seal member as well as by means of an elasticity of the back-up ring made from elastic material.

As stated above, a back-up ring is fitted into grooves for the back-up ring, which are engraved on the divided surfaces of the upper ring and the lower ring, in a place not facing the sealing grooves, along the longitudinal direction of the sliding contact surface, so that the back-up ring does not touch the orbiting member. Therefore, even when the orbiting member such as the orbiting scroll in scroll type compressors or scroll type vacuum pumps is operated at high temperature, a heat transfer from the orbiting member to the back-up ring is restrained and a thermal degradation of the back-up ring caused due to the heating-up by the heat transfer can be prevented.

Accordingly, the durability of the back-up ring is improved as a result of preventing the thermal degradation caused by the contact between the back-up ring and the inner face of the stationary member. Further it can be evaded for the sealing function of the back-up ring to be deteriorated by the thermal degradation, the sealing function being a back-up function for pressing the sliding contact surface of the upper ring 3 onto the inner surface of the stationary member (the end plate). In this way, even when the orbiting scroll is in operation at elevated temperature, a fluid seal condition between the sliding contact surface and the inner surface of the end plate is always maintained securely. As a result, a high volumetric efficiency is maintained.

In addition, although a substantially circular shape is suitable as the cross section shape of the back-up ring, the cross section can be a polygon section, or a cross-shaped section.

In a case where the cross section of the back-up ring is a polygon section or a cross-shaped section, the back-up ring can be stably fitted into the sealing groove without sliding on the grooves of the upper/lower ring in rotational direction (in twisted direction), because of the flat side part of the back-up ring along the longitudinal direction, Further, according to another aspect of the present invention, the sealing member or the tip sealing member is constructed such that the cross sections of the upper-ring and the lower-ring are of the same shape and the upper-ring, the lower-ring, and the back-up ring are assembled and/or disassembled separately.

According to the present invention as mentioned above, the shape of the cross section of the upper ring is the same as that of the lower ring and each of the upper ring, the lower ring, and the back-up ring is separately assembled into or disassembled from the sealing groove. Therefore, the upper ring and the lower ring are inter-changeable. To be more specifically, the upper ring and the lower ring for the lap of the orbiting member are inter-changeable with the lower ring and the upper ring for the lap of the stationary member respectively. When the sliding contact surface of the upper ring is worn out, the lower ring can be, with up side down, mounted in the space of the upper ring so that the upper surface (a surface facing the bottom of the sealing groove) of the lower ring becomes a substitute for the sliding contact surface which is pressed onto the inner surface of the stationary member (the end plate), so that the lower ring is reusable. Moreover, according to accumulated wear situation; the upper ring, the lower ring, and the back-up ring for the orbiting member are reusable as the lower ring, the upper ring, and the back-up ring for the stationary member respectively. Namely, the upper ring, the lower ring, and the back-up ring installed in the orbiting member, which are less sensitive to thermal degradation, are reusable. After all, a lifetime of the back-up ring can be prolonged.

According to the present invention, in a sealing device of fluid machinery including a scroll compressor or a scroll vacuum pump, the tip seal member to be fitted into a sealing groove engraved, on the end surface of the orbiting scroll sliding on the stationary member such as end plate, along the ridge line of the tip end surface is divided in a plane parallel to the sliding contact surface into two parts of an upper ring and a lower ring, the upper ring contacting the sliding contact surface and the lower ring facing a bottom surface of the sealing groove, and further grooves for back-up ring into which a back-up ring made from elastic material is fitted are engraved on the divided surfaces of the upper ring and the lower ring, in a place not facing the sealing grooves, along the longitudinal direction of the sliding contact surface. Therefore, the sliding contact surface of the upper ring is pressed onto the inner face of the stationary member (the end plate) by means of a pressure of a working fluid flowing into a clearance between the sealing groove and the sealing member as well as by means of an elasticity of the back-up ring made from elastic material, to secure a fluid seal between the sliding contact surface and the inner face of the end plate.

Further, by constructing such that the back-up ring does not contact the orbiting member, a heat transfer to the back-up ring from the orbiting member under operation at high temperature such as the orbiting scroll of a scroll compressor or a scroll vacuum pump is restrained. As a result, it becomes avoidable that a thermal degradation of the back-up ring is caused due to the heating-up by the heat transfer.

By such construction, while a fluid seal between the sliding contact surface of the upper ring and the inner face of the stationary member is secured, the durability of the back-up ring is improved: in addition, it can be evaded for the sealing function of the back-up ring to be deteriorated by the generated heat, the sealing function being a back-up function for pressing the sliding contact surface of the upper ring onto the inner surface of the stationary member. Thus, in a case where the orbiting member is operated at high temperature such as the above mentioned orbiting scroll, a fluid seal condition between the sliding contact surface and the inner surface of the stationary member is always maintained securely, maintaining a high volumetric efficiency.

Further, the shape of the cross section of the upper ring is the same as that of the lower ring, and each of the upper ring, the lower ring, and the back-up ring is separately assembled into or disassembled from the sealing groove, accordingly the upper ring and the lower ring are inter-changeable. When the sliding contact surface of the upper ring is worn down, the lower ring can be, with up side down, mounted in the space of the upper ring so that the upper surface (a surface facing the bottom of the sealing groove) of the lower ring becomes a substitute for the sliding contact surface which is pressed onto the inner surface of the stationary member (the end plate). Thus, the lower ring is reusable. As a result, a lifetime of the back-up ring can be prolonged, and the time between replacement of the upper ring and the lower ring can be extended.

From an outline view point, the present invention provides a sealing construction of a fluid machinery with an extremely simple seal construction, in which the sealing member is divided into two parts of an upper ring and a lower ring, the upper ring contacting the sliding contact surface and the lower ring facing a bottom surface of the sealing groove and grooves for fitting a back-up ring are engraved on the divided surfaces of the upper ring and the lower ring. Thus, the present invention realizes, with such extremely simple seal construction of less assembling and disassembling process, a sealing device of fluid machinery, which can evade a back-up ring contacting a sealing groove, thereby deterioration due to thermal degradation is lessened and deterioration of the sealing function and/or the volumetric efficiency is prevented.

BRIEF DESCRIPTION OF THE DRAWINGS

The present invention will now be described in greater detail with reference to the preferred embodiments of the invention and the accompanying drawings, wherein:

FIG. 4 is a perspective view of an orbiting scroll of a scroll type fluid machine that the present invention is applied to.

DETAILED DESCRIPTION OF THE PREFERRED EMBODIMENTS

Hereafter, the present invention will be described in detail with reference to the embodiments shown in the figures. However, the dimensions, materials, shape, the relative placement and so on of a component described in these embodiments shall be only for explanation and shall not be construed as limiting the scope of the invention thereto, unless any specific mention is placed.

Figure 4:
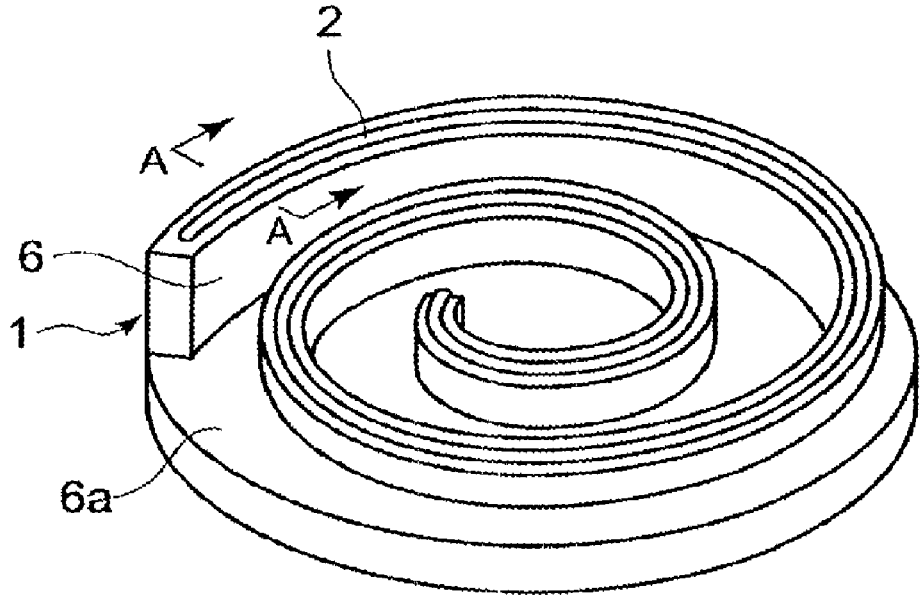
FIG. 4 Prior Art
Figure 5:
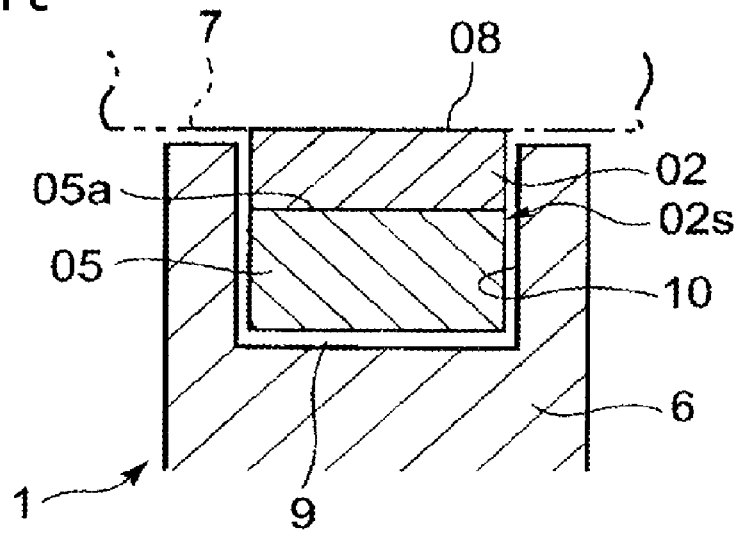
FIG. 5 Prior Art
FIG. 5 illustrates a conventional technology.

FIG. 4 is a perspective view regarding an orbiting scroll of a scroll type fluid machine as an application example of the present invention. In FIG. 4, the reference numeral 1 shows an orbiting scroll which moves along an inner surface of an end plate 7 (See FIG. 1) of a stationary scroll (not shown). Here, a lap 6 of a spiral wall shape is set-up on a base plate 6*a* of the orbiting scroll 1, a sealing groove 10 is engraved on the wall end surface, namely, an end surface of the lap 6 along the ridge line of the end surface of the orbiting scroll 1, and a tip seal 2 is fitted into the sealing groove.

The present invention relates to a fluid seal construction applicable for scroll-type fluid machines between a sliding surface of sealing members (tip seal elements) and an inner surface of stationary member.

First Embodiment

Figure 1:
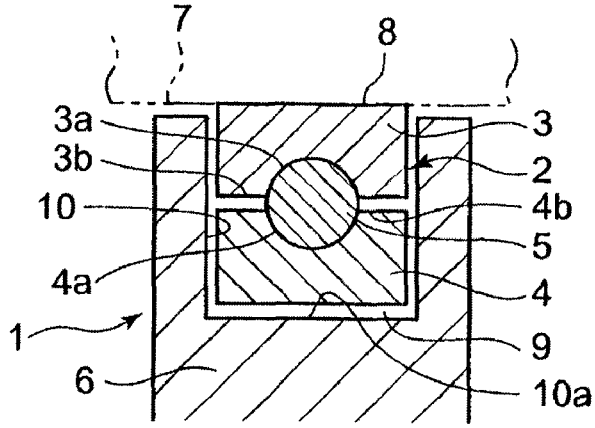
FIG. 1 shows a partial cross section (A-A cross section in FIG. 4) of primary parts of a scroll type fluid machine relating to a first embodiment of the present invention.

FIG. 1 is a partial cross section (A-A cross section in FIG. 4) showing a tip seal construction of a scroll type fluid machine relating to a first embodiment of the present invention.

In FIG. 1, reference numeral 6 shows a lap of the orbiting scroll, 7 is an end plate composing the stationary member, and 10 is a sealing groove engraved on the tip end surface of the lap 6 along the ridge line of the tip end surface of the orbiting scroll 1.

The reference numeral 2 shows a tip seal member comprising of an upper ring 3, which forms a sliding contact surface 8 on the inner surface of the end plate 7, and a lower ring 4, the lower side of which faces a bottom surface 10*a* of the sealing groove 10. Here, the tip seal member is divided in a plane parallel to the sliding contact surface 8 into two parts of the upper ring 3 and the lower ring 4.

The reference numerals 3*a* and 4*a* show engraved grooves for receiving a back-up ring (grooves for a back-up ring 5). The grooves 3*a* and 4*a* are engraved on the divided surfaces of the upper ring 3 and the lower ring 4 respectively so that the grooves for the back-up ring do not face to the sealing groove and are located inside, namely in the central part of the seal member.

The reference numeral 5 shows the above-mentioned back-up ring which is fitted into the grooves 3*a* and 4*a*.

According to the first embodiment, a tip seal member 2 is fitted into the sealing groove 10 engraved on the end surface of the lap, along the ridge line of the end surface of the orbiting scroll 1 which slides on an inner face of the end plate 7. The tip seal member 2 is divided in a plane parallel to the sliding contact surface 8 into two parts of an upper ring 3 and a lower ring 4, in which the upper ring 3 serves to form the sliding contact surface 8 and the lower ring 4 faces a bottom surface of the sealing groove 10; wherein grooves 3*a* and 4*a* for a back-up ring 5 are engraved on the divided surfaces 3*b* and 4*b* of the upper ring 3 and the lower ring 4 so that the grooves 3*a* and 4*a* for the back-up ring 5 do not face to the sealing groove 10, being engraved along the longitudinal direction of the sliding contact surface 8, and the back-up ring made from elastic material is fitted into the grooves 3*a* and 4*a* for the back-up ring. Thus, the sliding contact surface 8 of the upper ring 3 is pressed onto the inner face of the end plate 7 by means of a pressure of a working fluid which flows into a clearance 9 between the sealing groove 10 and the tip seal member 2 as well as by means of an elasticity of the back-up ring 5 made from elastic material, thereby it is possible to secure a fluid seal between the sliding contact surface 8 and the inner face of the end plate 7

Moreover, according to the first embodiment, the back-up ring 5 is fitted into the grooves 3*a* and 4*a* which are engraved on the divided surfaces of the upper ring 3 and the lower ring 4 in the central part of the seal member so as not to face to the sealing groove 10. Since the back-up ring 5 are not in contact with the lap 6 of the orbiting scroll 1, even when the temperature of the lap 6 is raised during operation, a heat transfer from the lap 6 to the back-up ring 5 is restrained. As a result, it is possible to prevent a thermal degradation of the back-up ring 5 caused by the heating-up by the heat transfer.

By constructing like this, the durability of the back-up ring 5 is improved, it can be evaded for the buck-up function of the back-up ring 5 for pressing the sliding contact surface 8 of the upper ring 3 onto the inner surface of the end plate 7 to be deteriorated by the thermal degradation. In this way, even when the orbiting scroll 1 is operated in at an elevated temperature, a fluid seal condition between the sliding contact surface and the inner surface of the end plate is always maintained securely, and a high volumetric efficiency is maintained.

Furthermore, according to the first embodiment, the shape of the cross section of the upper ring 3 is the same as that of the lower ring 4, and moreover each of the upper ring 3, the lower ring 4, and the back-up ring 5 is separately mountable into or dismountable from the sealing groove 10. Therefore, the upper ring 3 and the lower ring 4 are inter-changeable. More exactly, the upper ring and the lower ring for the lap of the orbiting scroll are inter-changeable to the lower ring and the upper ring for the lap of the stationary scroll respectively. When the sliding contact surface 8 of the upper ring 3 is worn out, the lower ring 4 can be, with up side down, mounted in the space of the upper ring 3 so that the upper surface (a surface facing the bottom of the sealing groove 10) of the lower ring 4 becomes a substitute for the sliding contact surface 8 which is pressed onto the inner surface of the end plate 7. Thus, the lower ring 4 is reusable. Moreover, according to accumulated wear; the upper ring 3, the lower ring 4, and the back-up ring 5 for the orbiting scroll are reusable as the lower ring 4, the upper ring 3, and the back-up ring 5 for the stationary scroll respectively. Namely, the upper ring 3, the lower ring 4, and the back-up ring 5 installed in the orbiting scroll, which are less sensitive to thermal degradation, are reusable. After all, a lifetime of the back-up ring 5 can be prolonged.

Second Embodiment

Figure 2A:
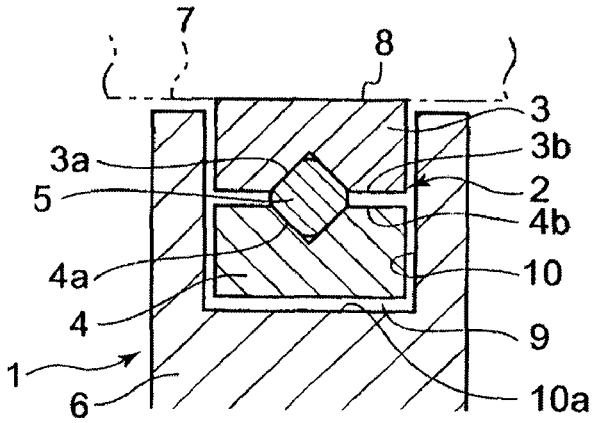
FIG. 2(A) and FIG. 2(B) illustrate a second embodiment of the present invention corresponding to FIG. 1.
Figure 2B:
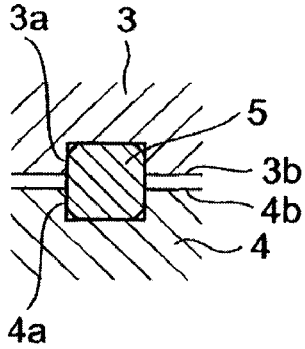

Corresponding to FIG. 1, FIG. 2(A) and FIG. 2(B) illustrate a second embodiment of the present invention.

In the second embodiment, the cross section of the aforementioned back-up ring is of a square shape with its corners chamfered.

In FIG. 2(A), the corners of the cross section square are located at up and down sides as well as at right and left sides. Therefore, the back-up ring is fitted into grooves 3*a* and 4*a* of a triangle shape. In FIG. 2(B), the sides of the cross section square are located at up and down sides as well as at right and left sides. Therefore, the back-up ring is fitted into grooves 3*a* and 4*a* of a rectangular shape.

The other construction is the same as that of the above first embodiment; the same part as that of the first embodiment is quoted with the same reference numeral.

According to the second embodiment, the plane parts of the back up ring 5 and the grooves 3*a* and 4*a* for the back-up ring 5 prevent the back-up ring from sliding on the grooves 3*a* and 4*a* in rotational direction, therefore the back-up ring 5 can be stably fitted into the sealing groove 10 without relative movements between the upper and lower rings 3 and 4 and the back-up ring.

Third Embodiment

Figure 3:
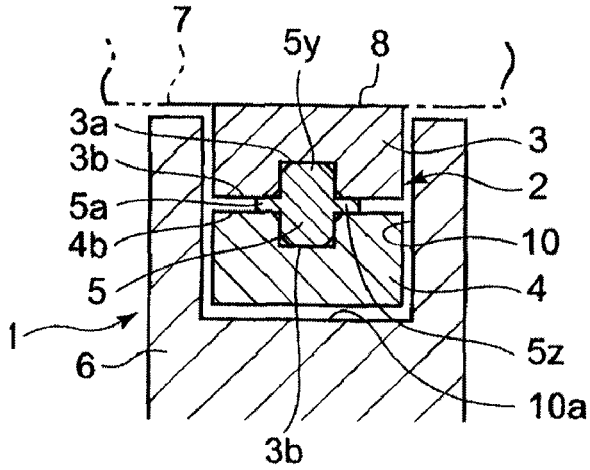
FIG. 3 illustrates a third embodiment of the present invention corresponding to FIG. 1.

Corresponding to FIG. 1, FIG. 3 illustrates a third embodiment of the present invention.

In the third embodiment, the cross section of the aforementioned back-up ring is of a cross-shaped section wherein a perpendicular part 5*y* is fitted into grooves 3*a* and 4*a* for the back-up ring of square shape, and a flat part 5*z* is inserted between the divided surfaces 3*b* and 4*b* of the upper ring 3 and the lower ring 4.

The other construction is the same as that of the above first embodiment; the same part as that of the first embodiment is quoted with the same reference numeral.

According to the third embodiment, owing to the sides of the perpendicular part 5*y* of the back-up ring 5, the flat part 5*z* of the back-up ring 5, the plane surfaces of the grooves 3*a*/4*a* for the back-up ring 5, the back-up ring is prevented from sliding on the grooves 3*a* and 4*a* in rotational direction. Therefore, the back-up ring 5 can be stably fitted into the sealing groove 10 without relative movements between the upper and lower rings 3 and 4 and the back-up ring.

Conclusively, the present invention provides a sealing device for fluid machinery, with an extremely simple construction for assembling and disassembling, which can evade a contact of a back-up ring onto a sealing groove of a orbiting member. Therefore, deterioration of the back-up ring due to thermal degradation caused by the contact can be prevented, and resulting deterioration of the sealing function and/or the volumetric efficiency is lessened.

In addition, the above embodiments are explained as applied in the orbiting scroll, nevertheless it may be applied in the stationary scroll.

What is claimed is:

1. A sealing device of fluid machinery, comprising:

a stationary member;

a orbiting member, an end surface of which slides on an inner face of the stationary member; and a sealing member to be fitted into a sealing groove engraved on the end surface along the ridge line of the end surface, a sliding contact surface of the sealing member being pressed onto an inner surface of the stationary member with a predetermined force to slide on the inner surface in order that fluid sealing is secured between the sliding contact surface of the sealing member and the inner surface of the stationary member;

wherein the sealing member is divided in a plane parallel to the sliding contact surface into two parts of an upper ring and a lower ring, the upper ring contacting the sliding contact surface and the lower ring facing a bottom surface of the sealing groove; and a back-up ring made from elastic material is provided to be fitted into grooves for the back-up ring, which are engraved on the divided surfaces of the upper ring and the lower ring, in a place not facing the sealing groove, along the longitudinal direction of the sliding contact surface.

2. A sealing device of fluid machinery including a scroll compressor or a scroll vacuum pump, comprising:

a stationary scroll;

an orbiting scroll, a tip end surface of which slides on an inner face of the stationary scroll; and a tip seal member to be fitted into a sealing groove engraved on the end surface along the ridge line of the end surface, a sliding contact surface of the tip seal member being pressed onto the inner surface of an end plate of the stationary scroll with a predetermined force to slide on the inner surface in order that fluid sealing is secured between the sliding contact surface of the tip seal member and the inner surface of the end plate of the stationary scroll;

wherein the tip seal member is divided in a plane parallel to the sliding contact surface into two parts of an upper ring and a lower ring, the upper ring contacting the sliding contact surface and the lower ring facing a bottom surface of the sealing groove; and a back-up ring made from elastic material is provided to be fitted into grooves for the back-up ring, which are engraved on the divided surfaces of the upper ring and the lower ring, in a place not facing the sealing grooves, along the longitudinal direction of the sliding contact surface.

3. A sealing device of fluid machinery according to claim 1 or 2, wherein the cross sections of the upper-ring and the lower-ring are of the same shape, and the upper-ring, the lower-ring and the back-up ring are disposed to be assembled and/or disassembled separately.

4. A sealing device of fluid machinery according to claim 1 or 2, wherein the cross section of the back-up ring is a circular section, a polygon section, or a cross-shaped section.

* * * * *